US007066241B2

(12) United States Patent
Garimella

(10) Patent No.: US 7,066,241 B2
(45) Date of Patent: Jun. 27, 2006

(54) METHOD AND MEANS FOR MINIATURIZATION OF BINARY-FLUID HEAT AND MASS EXCHANGERS

(75) Inventor: Srinivas Garimella, Smyrna, GA (US)

(73) Assignee: Iowa State Research Foundation, Ames, IA (US)

( * ) Notice: Subject to any disclaimer, the term of this patent is extended or adjusted under 35 U.S.C. 154(b) by 150 days.

(21) Appl. No.: 10/894,325

(22) Filed: Jul. 19, 2004

(65) Prior Publication Data

US 2005/0006064 A1 Jan. 13, 2005

Related U.S. Application Data

(63) Continuation-in-part of application No. 09/669,056, filed on Sep. 25, 2000, now Pat. No. 6,802,364, which is a continuation of application No. 09/253,155, filed on Feb. 19, 1999, now abandoned.

(51) Int. Cl.
*B01F 3/04* (2006.01)

(52) U.S. Cl. ..... 165/116; 62/497

(58) Field of Classification Search ..... 165/140, 165/143, 144, 145, 150, 157, 162, 163, 111–116; 62/484, 494, 497

See application file for complete search history.

(56) References Cited

U.S. PATENT DOCUMENTS

| | | | |
|---|---|---|---|
| 977,538 | A | 12/1910 | Odenkirk |
| 1,024,554 | A | 4/1912 | Carter et al. |
| 1,067,689 | A | 7/1913 | Spotts |
| 1,394,502 | A | 10/1921 | Piscek |
| 1,617,083 | A | 2/1927 | Price |
| 1,759,750 | A | 5/1930 | Katzebue |
| 1,818,762 | A | 8/1931 | Kin |
| 1,846,067 | A | 2/1932 | Sadtler |
| 1,915,805 | A | 6/1933 | Sutcliffe |
| 2,750,159 | A | 6/1956 | Edner |
| 2,941,786 | A | 6/1960 | Kuljian et al. |
| 3,146,609 | A | 9/1964 | Engalitcheff, Jr. |

(Continued)

FOREIGN PATENT DOCUMENTS

| | | |
|---|---|---|
| DE | 375613 | 5/1923 |

(Continued)

OTHER PUBLICATIONS

Performance Evaluation of a Generator-Heat-Exchange Heat Pump—Srinivas Garmiella, et al—Sep. 22, 1995.

(Continued)

*Primary Examiner*—John Fox

(57) ABSTRACT

A binary-fluid heat and mass exchanger has a support structure with a plurality of horizontal vertically spaced groups of tubes mounted thereon. Each group of tubes comprises a pair of horizontal spaced hollow headers. A plurality of small diameter hollow tubes extend between the headers in fluid communication therewith. Fluid conduits connect a header of one group of tubes with a header of an adjacent group of tubes so that all of the groups of tubes will be fluidly connected. An inlet port for fluid is located on a lower group of tubes, and an exit port for fluid is connected to a higher tube group to permit fluid to flow through the tubes in all of the groups. A second inlet port for introducing a solution of fluid downwardly over the tubes is located above the support structure. An outlet port is located at the top of the support structure to convey generated vapor upwardly through the groups and out of the heat exchanger. A fluid exit port is located below the support structure for the removal of fluid collected from the various groups of tubes.

1 Claim, 8 Drawing Sheets

U.S. PATENT DOCUMENTS

| | | | | |
|---|---|---|---|---|
| 3,690,121 | A | 9/1972 | Patel | |
| 3,824,154 | A | 7/1974 | Tkeda et al. | |
| 4,318,872 | A | 3/1982 | Romano | |
| 4,386,652 | A | 6/1983 | Dragojevic | |
| 4,418,749 | A | 12/1983 | Vasilieve et al. | |
| 4,441,549 | A | 4/1984 | Vasilieve et al. | |
| 4,475,587 | A | 10/1984 | Vasilieve et al. | |
| 4,477,396 | A | 10/1984 | Wilkinson | |
| 4,537,248 | A | 8/1985 | Minami | |
| 4,548,048 | A | 10/1985 | Reimann et al. | |
| 4,719,767 | A | 1/1988 | Reid, Jr. et al. | |
| 4,742,693 | A | 5/1988 | Reid, Jr. et al. | |
| 4,926,659 | A | 5/1990 | Christensen et al. | |
| 5,007,251 | A | 4/1991 | Thuez et al. | |
| 5,009,085 | A | 4/1991 | Ramshaw et al. | |
| 5,016,445 | A | 5/1991 | Wehr | |
| 5,067,330 | A | 11/1991 | Cook et al. | |
| 5,205,276 | A | 4/1993 | Aronov et al. | |
| 5,230,225 | A | 7/1993 | George, II et al. | |
| 5,237,839 | A | 8/1993 | Debne | |
| 5,303,565 | A | 4/1994 | Pravda | |
| 5,381,673 | A | 1/1995 | Lee et al. | |
| 5,452,758 | A | 9/1995 | Mauterer | |
| 5,463,880 | A | 11/1995 | Nishino et al. | |
| 5,490,393 | A | 2/1996 | Fuesting et al. | |
| 5,524,454 | A | 6/1996 | Hollingsworth | |
| 5,533,362 | A | 7/1996 | Cook et al. | |
| 5,546,760 | A | 8/1996 | Cook et al. | |
| 5,572,884 | A | 11/1996 | Christensen et al. | |
| 5,572,885 | A | 11/1996 | Erickson | |
| 5,600,968 | A | 2/1997 | Jernqvist et al. | |
| 5,617,737 | A | 4/1997 | Christensen et al. | |
| 5,704,417 | A | 1/1998 | Christensen et al. | |
| 5,724,829 | A * | 3/1998 | Schubach et al. | 62/497 |
| 5,832,994 | A | 11/1998 | Nomura | |
| 5,927,388 | A | 7/1999 | Blangetti et al. | |
| 6,314,752 | B1 * | 11/2001 | Christensen et al. | 62/497 |

FOREIGN PATENT DOCUMENTS

| | | |
|---|---|---|
| DE | 18172 | 9/1956 |
| DE | 972293 | 7/1959 |
| DE | 0236983 | 6/1986 |
| FR | 1027821 | 5/1953 |
| FR | 2563619 | 10/1985 |
| JP | D 169295 | 7/1987 |

OTHER PUBLICATIONS

Heat Transfer and Pressure Drop Characteristics of Spirally Fluted Annuli: Part I—Hydrodynamics—S. Garimella, et al.—Transactions of the ASME—54/vol. 117, Feb. 1995.

Heat Transfer and Pressure Drop Characteristics of Spirally Fluted Annuli: Part II -Heat Transfer Journal of Heat Transfer, vol. 117/61—Feb. 1995.

Air-Cooled Condensation of Ammonia in Flat-Tube, Multi-Louver Fin Heat Exchangers Srinivas Garimella, et al. HTD-vol. 1, Advances in Enhanced Heat/Mass Transfer and Energy Efficiency—ASME 1995.

Simulation and Performance Analysis of BasicGax and Advanced Gax Cycles with Ammonia/Water and Ammonia/Water/LiBr Absorption Fluids, A. Zaltash, et al. Date__.

Development of a Counter-Current Model for a Vertical Fluted Tube Gax Absorber—Yong Tae Kang, et al.—AES vol. 31, International Absorption Heat Pump Conference—ASME 1993.

The Modeling and Optimization of a Generator Absorber—Kevin R. McGahey, et al. AES-vol. 29 Heat Pump and Refrigeration Systems Design, Analysis, and Applications ASME 1993.

Compact Bubble Absorber Design and Analysis—T. Merrill, et al., AES-vol. 21, International Absorption heat Pump Conference—ASME 1993.

Vertical-Tube Aqueous LiBr Falling Film Absorption Using Advanced Surfaces, William A. Miller, et al. AES-vol. 31, International Absorption Heat Pump Conference ASME 1993.

Water Absorption in an Adiabatic Spray of Aqueous Lithium Bromide Solution, William A. Ryan—AES-vol. 31, International Absorption Heat Pump Conference—ASME—1993.

Space-Conditioning Using Triple-Effect Absorption Heat Pumps—Srinivas Garimella, et al., Applied Thermal Engineering, vol. 17, No. 12, pp. 1183-1197, 1997.

* cited by examiner

METHOD AND MEANS FOR MINIATURIZATION OF BINARY-FLUID HEAT AND MASS EXCHANGERS

CROSS REFERENCE TO RELATED APPLICATIONS

This application is a continuation-in-part of application Ser. No. 09/669,056 filed Sep. 25, 2000, now U.S. Pat. No. 6,802,364 which is a continuation of application Ser. No. 09/253,155 filed Feb. 19, 1999 now abandoned.

BACKGROUND OF THE INVENTION

Absorption heat pumps are gaining increased attention as an environmentally friendly replacement for the CFC-based vapor-compression systems that are used in residential and commercial air-conditioning. These heat pumps rely heavily on internal recuperation to yield high performance. Several studies have shown that the high coefficients of performance of these thermodynamic cycles cannot be realized without the development of practically feasible and compact heat exchangers. While significant research has been done on absorption cycle simulation, innovations in component development have been rather sparse, in spite of the considerable influence of component performance on system viability. There have been some advances in the design of compact geometries for components such as condensers and in the use of fluted tubes to enhance single-phase components such as solution-solution heat exchangers. But absorption and desorption processes involve simultaneous heat and mass transfer in binary fluids. For example, in a Lithium Bromide-Water (LiBr—$H_2O$) cycle, absorption of water vapor in concentrated LiBr—$H_2O$ solutions occurs in the absorber with the associated rejection of heat to the ambient or an intermediate fluid. Successful designs for such binary fluid heat and mass exchangers must address the following often contradictory requirements:

- low heat and mass transfer resistances for the absorption/desorption side.
- adequate transfer surface area on both sides.
- low resistance of the coupling fluid—designs have been proposed in the past that enhance absorption/desorption processes, but fail to reduce the single-phase resistance on the other side, resulting in large components.
- low coupling fluid pressure drop—to reduce parasitic power consumption.
- low absorption side pressure drop—this is essential because excessive pressure drops, encountered in forced-convective flow at high mass fluxes, decrease the saturation temperature and temperature differences between the working fluid and the heat sink.

Most of the available absorber/desorber concepts fall short in one or more of the above-mentioned criteria essential for good design.

It is therefore a principal object of this invention to provide a method and means for miniaturization of binary-fluid heat and mass exchangers which will permit designs that are compact, modular, versatile, easy to fabricate and assemble, and wherein use can be made of existing heat transfer technology without special surface preparation.

These and other objects will be apparent to those skilled in the art.

SUMMARY OF THE INVENTION

This invention addresses the deficiencies of currently available designs. It is an extremely simple geometry that is widely adaptable for a variety of miniaturized absorption system components. It can be used for fluid pairs with non-volatile and volatile absorbents. It promotes high heat and mass transfer rates through flow mechanisms such as counter-current vapor-liquid flow, vapor shear, droplet entrainment, adiabatic absorption between tubes, species concentration redistribution due to liquid droplet impingement, significant interaction between vapor and liquid flow around adjacent tubes in the transverse and vertical directions, and other deviations from idealized falling films. It ensures uniform distribution of the liquid and vapor films and high wettability of the transfer surfaces.

Short lengths of very small diameter tubes are placed in a square array, with several such arrays being stacked vertically. Successive tube arrays are oriented in a transverse orientation perpendicular to the tubes in adjacent levels. In an absorber application, the liquid solution flows in the falling-film mode counter-current to the coolant through the tube rows. Vapor flows upward through the lattice formed by the tube banks, counter-current to the falling solution. The effective vapor-solution contact minimizes heat and mass transfer resistances, the solution and vapor streams are self-distributing, and wetting problems are minimized. Coolant-side heat transfer coefficients are extremely high without any passive or active surface treatment or enhancement, due to the small tube diameter.

DESCRIPTION OF THE PREFERRED EMBODIMENT

Figure 1:
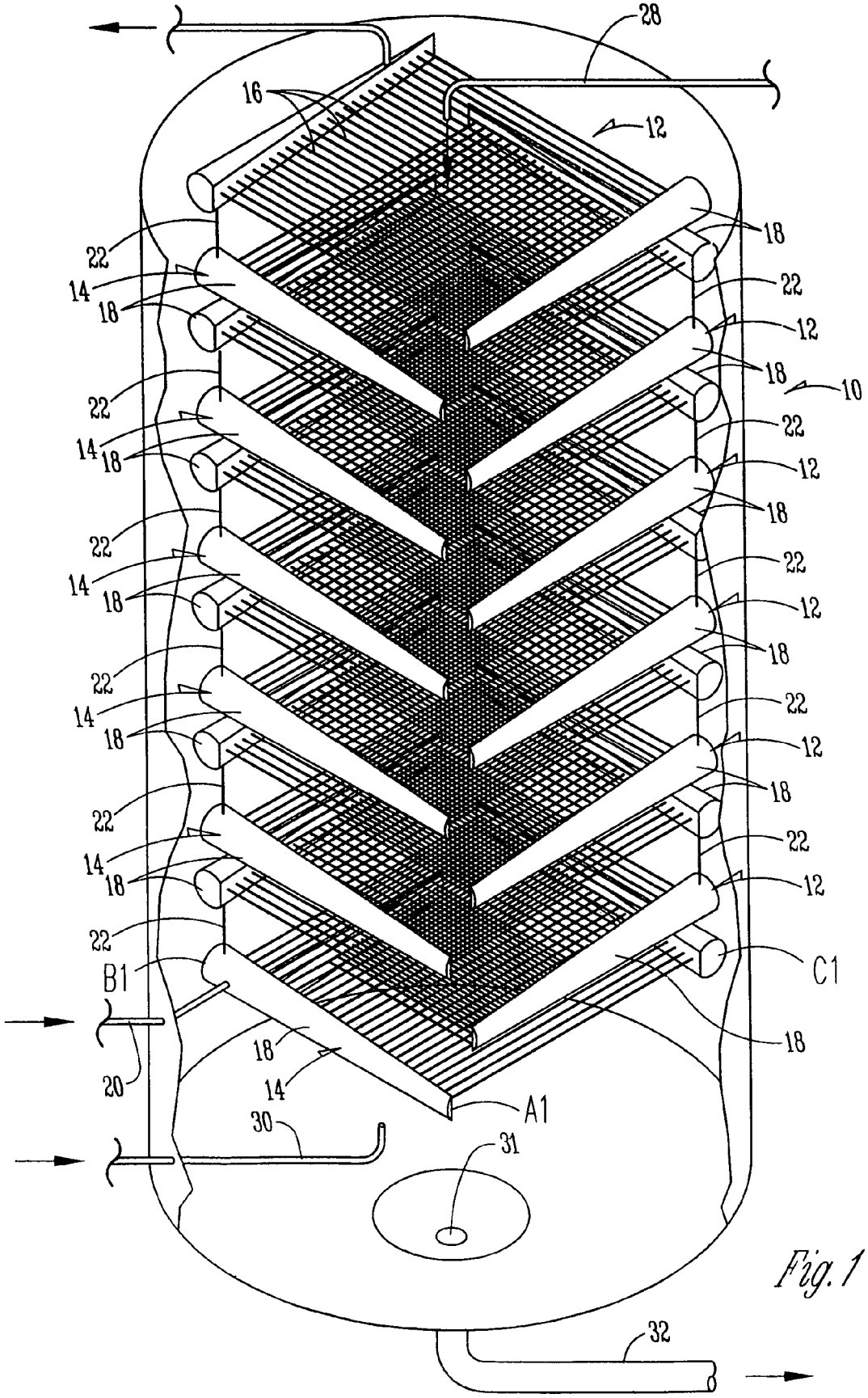
FIG. 1 is a schematic broken-away perspective view of an apparatus of this invention.
Figure 2:
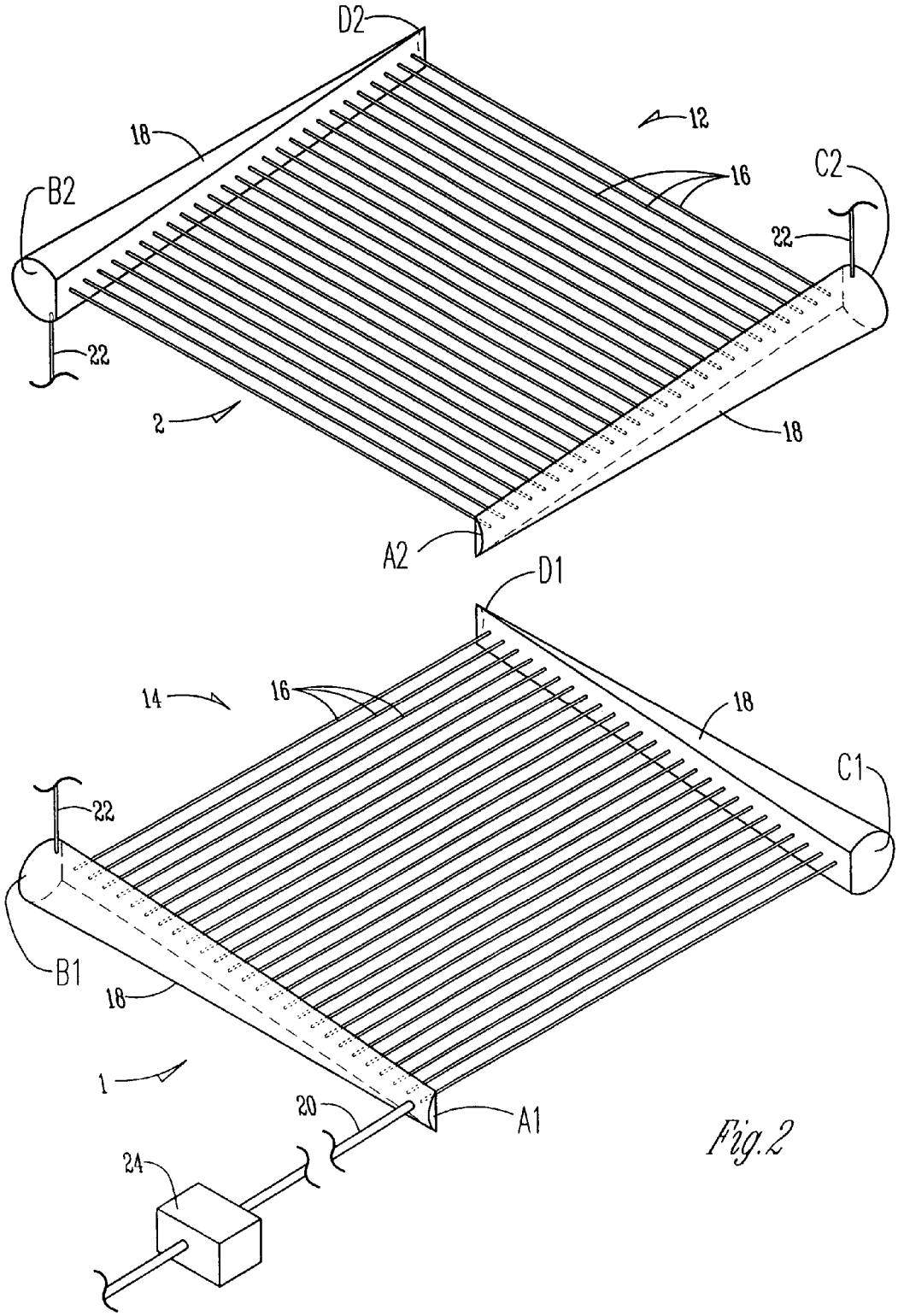
FIG. 2 is an enlarged scale perspective view of adjacent groups of coolant tubes.

With reference to FIG. 1, the numeral 10 designates a support structure wherein alternate groups of coolant tubes 12 and 14 (FIG. 1) are mounted in spaced vertical relation in structure 10. Each group 12 and 14 is comprised of a plurality of small diameter coolant tubes 16 which extend between opposite headers 18. (FIGS. 1 and 2). The orientation of the tubes 16 in group 12 is at right angles to the orientation of tubes 16 in group 14 (FIG. 2). The tubes 16 in each group are in fluid communication with headers 18.

Hydronic fluid is introduced into the lowermost group of tubes at 20 (FIG. 1), and successive groups are fluidly connected by conduits 22.

The short lengths of very thin tubes 16 (similar to hypodermic needles) are placed in an approximately square array.

This array forms level 1 (FIG. 2), depicted by the square A1-B1-C1-D1. The second array (level 2) of thin tubes 16 is placed above level 1, but in a transverse orientation perpendicular to the tubes in level 1, depicted by A2-B2-C2-D2. A lattice of these successive levels is formed, with the number of levels determined by the design requirements. Hydronic fluid (coolant) is manifolded through these tubes 16 pumped into the system by pump 24 through conduit 20 (FIG. 2). Thus the fluid enters level 1 at A1 and flows in the header in direction A1-B1. As it flows through the header, the flow is distributed in parallel through all the tubes in level 1. In an actual application, the number of parallel passes can be determined by tube-side heat transfer and surface area requirements, and pressure drop restrictions. The fluid flows through the tubes 16 from A1-B1 to C1-D1. The fluid collected in the outlet header C1-D1 flows through the outlet connector tube D1-D2 to the upper level. The inlet and outlet headers 18 are appropriately tapered to effect uniform hydronic flow distribution between the tubes. In level 2, the fluid flows in parallel through the second row of tubes from D2-B2 to C2-A2. This flow pattern is continued, maintaining a globally rotating coolant flow path through the entire stack until the fluid exists at the outlet of the upper-most header.

This configuration yields extremely high coolant-side heat transfer coefficients even though the flow is laminar, due to the small tube diameter. In conventional heat exchangers, however, the coolant side heat transfer resistance is often dominant, resulting in unduly large components. The high values are achieved without the application of any passive or active heat transfer enhancement techniques, which typically add to the cost and complication of heat exchangers. In addition, the coolant-side pressure drop can be maintained at desirable values simply by modifying the pass arrangement (even to be in parallel across multiple levels), thus ensuring low parasitic power requirements.

Figure 3:
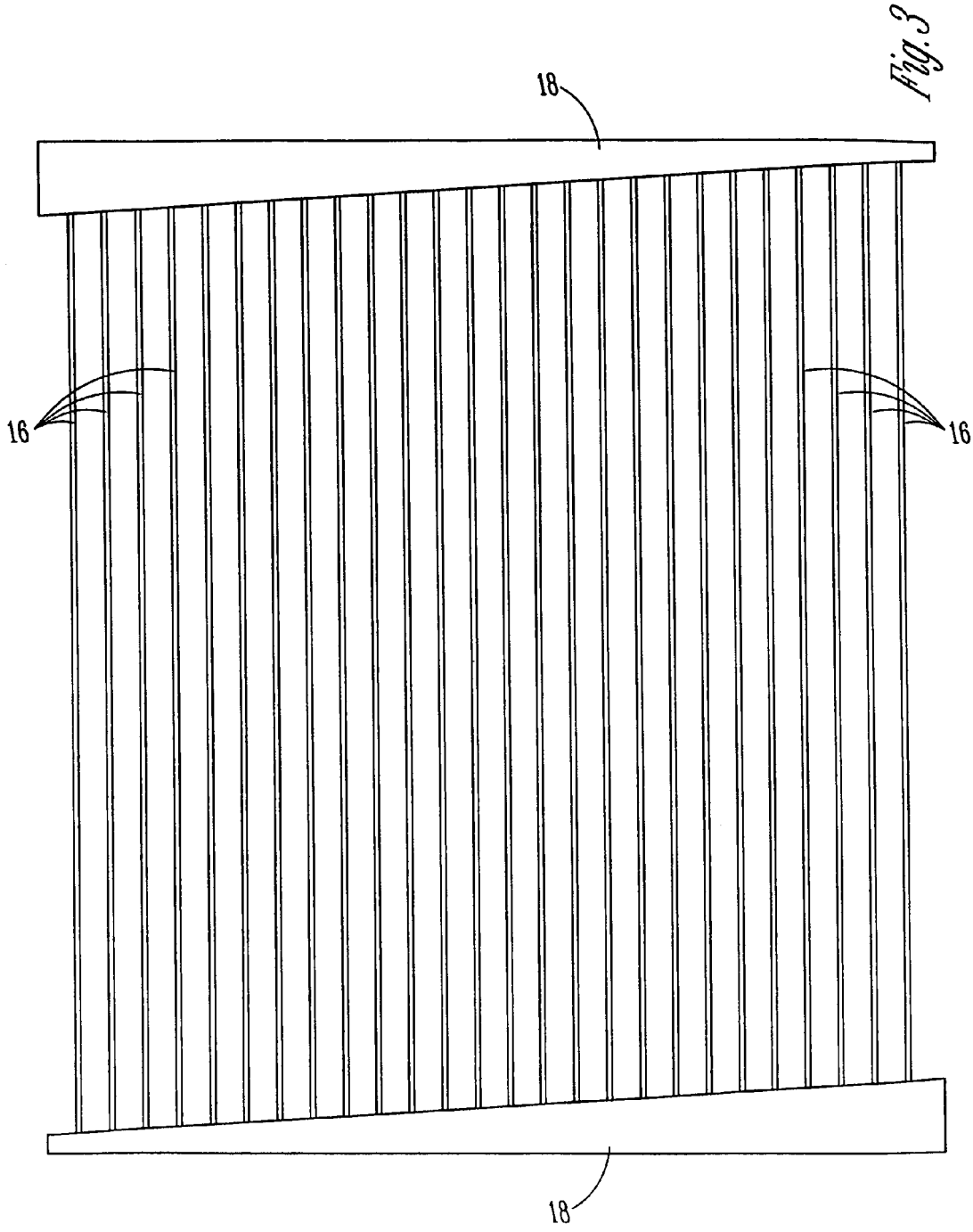
FIG. 3 is an enlarged scale plan view of a typical group of coolant tubes.
Figure 4:
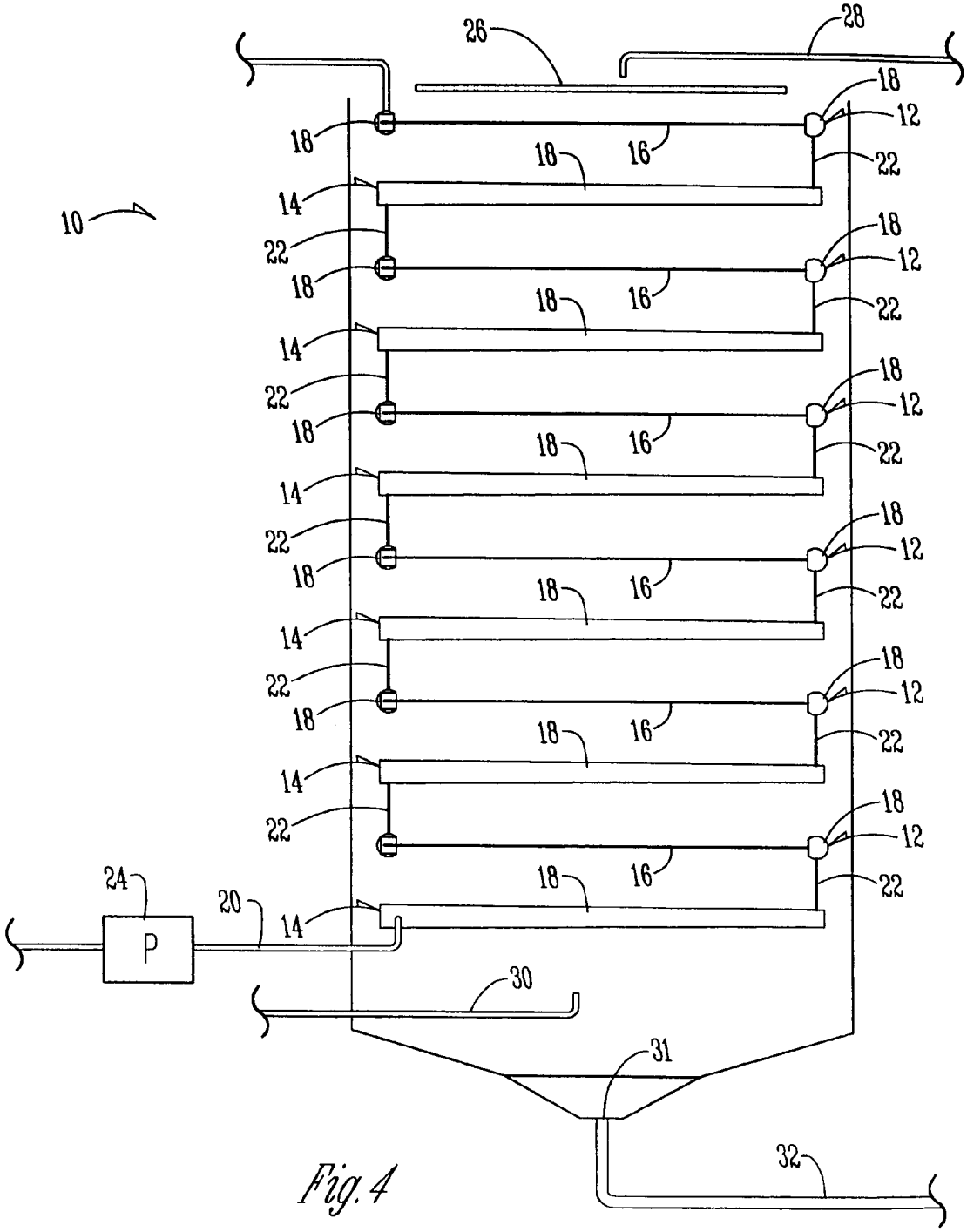
FIG. 4 is a schematic elevational view of the apparatus of FIG. 1.
Figure 5:
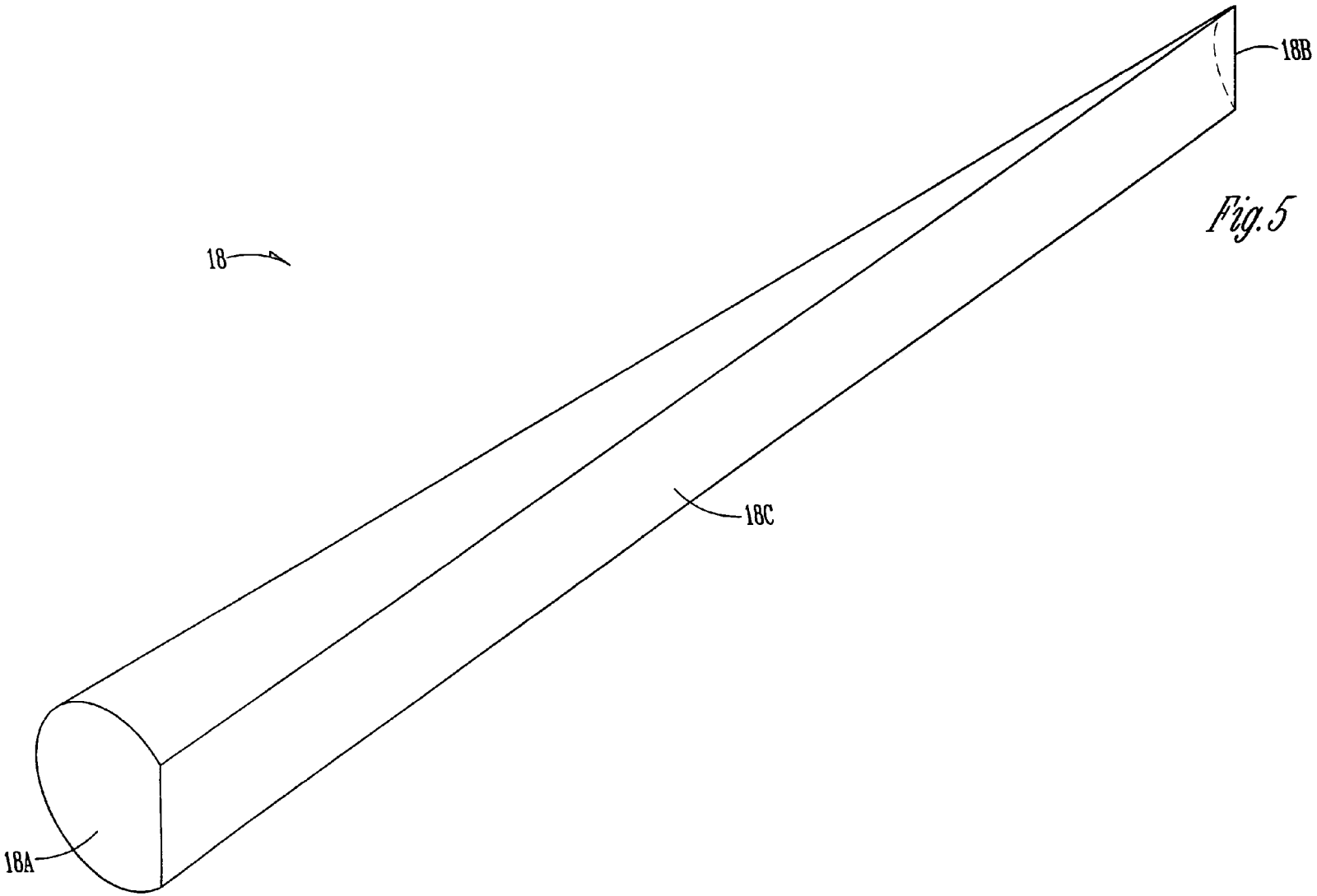
FIG. 5 is an enlarged scale perspective view of a header used in FIG. 1.

The headers 18 are tapered in cross section from one end to the other. One form of construction is best shown in FIG. 5 where a length of hollow cylindrical pipe has been cut both longitudinally and diagonally to create a larger end 18A and a narrow end 18B. The ends 18A and 18B are closed by appropriately shaped end pieces, and the diagonal cut is closed with a plate 18C. A plurality of apertures are drilled in the plates 18C to receive the ends of hollow tubes 16 so that the interiors of the tubes 16 are in fluid communication with the interior of headers 18. The plates 18C in the opposite headers of each group are preferably parallel to each other (See FIG. 3).

In an absorber application, a distribution device 26 (e.g., punched orifice plate) located above the uppermost row of tubes 16 through outlet 28 distributes weak solution so that it flows in the falling-film mode counter-current to the coolant through this lattice of heat exchanger rows. (Plate 26 has been omitted from FIG. 1 for clarity.) Vapor is introduced into the heat exchanger 10 at the bottom thereof via tube 30 (FIG. 1). The vapor flows upward through the lattice formed by the coolant tubes 16, counter-current with respect to the gravity-driven falling dilute solution. Spacing (vertical and transverse) between the tubes 16 is easily adjustable to ensure the desired vapor velocities as the local vapor and solution flow rates change due to absorption, and adequate adiabatic absorption of refrigerant vapor between levels. Such an arrangement virtually eliminates inadequate wetting of the heat exchanger surface (of tubes 16) which is a common problem in conventional heat exchangers. The resulting effectiveness of the contact between the vapor and the dilute solution, and the solution and the coolant through the tubes, minimizes heat and mass transfer resistances. The heat of absorption is conveyed to the coolant with minimal tube-side resistance due to the high heat transfer coefficients described above.

The influence of vapor shear and the resulting film turbulence is very significant, especially at the vapor velocities required to maintain compactness. This is not only important in enhancing the transfer coefficients typical of smooth films, but also will cause droplet entrainment in the vapor phase. Adequate spacing between tubes 16 can be provided to avoid flooding and flow reversal of the liquid solution due to high counter current vapor velocities. Because of the proximity of tubes 16 in the horizontal plane, surface tension effects will act in opposition to vapor shear and determine the conditions necessary for the bridging of the vapor film. Liquid phase droplets play a key role in several aspects of the absorption process by providing adiabatic absorption surface area. Thus, the concentration and temperature of the fluid droplets arriving at the top of a tube 16 will be different from the values at the bottom of, the preceding tube 16. The amount of absorption that can occur depends on various factors including the equilibrium concentration, which would be reached only when the entire droplet reaches saturation. The approach to this "ideal" concentration depends on the distance between the successive tubes 16 and also in the gradients established within the drop. An associated phenomenon is droplet impingement on succeeding tubes and the consequent re-distribution of the concentration gradients. This helps establish a new, well-mixed concentration profile at the top of each tube. In some situations, the droplet impingement could also result in secondary droplets leaving the tube to be re-entrained. Surface wettability is not a concern for the proposed configuration of FIG. 1. This configuration is self-distributing, and offers adequate surface area for the fluid to contact the surfaces of tubes 16 due to the lattice structure of the tube banks. In addition, if carbon steel tubes 16 are used with ammonia-water solutions, the oxide layer formed provides a fine porous surface that promotes wetting. The concentrated solution flowing around tubes 16 and moving by gravity to drain 31 and concentrated fluid discharge pipe 32 are best shown in FIG. 1.

The concept of FIGS. 1 and 2 is an extremely simple geometry that is widely adaptable to a variety of absorption system components. It can be used for fluid pairs with non-volatile and volatile absorbents. It promotes high heat and mass transfer rates through flow mechanisms such as counter-current vapor-liquid flow, vapor shear, adiabatic absorption between tubes, species concentration redistribution due to liquid droplet impingement, and significant interaction between vapor and liquid flow around adjacent tubes in the transverse and vertical directions. It ensures uniform distribution of the liquid and vapor films and high wettability of the transfer surfaces.

The coolant-side heat transfer coefficients are extremely high even though the flow is laminar, due to the small tube diameter ($h=Nu\ k/D$, $D \rightarrow O$.). The high values are achieved without any passive or active heat transfer enhancement, which typically increases cost and complexity. In addition, coolant pressure drop ($\Delta P$) can be minimized simply by modifying the pass arrangement (parallel flow within one level and/or across multiple levels), ensuring minimal parasitic power requirements. In an absorber application, the distribution plate 26 (e.g., orifice plate) above the first row of tubes distributes solution so that it flows in the falling-film mode counter-current to the coolant through the heat exchanger rows. Vapor is introduced at the bottom, and flows upward through the lattice formed by the tube groups through outlet 30, counter-current to the gravity-driven falling solution. The spacing (vertical and transverse) between the tubes is adjustable to ensure the desired vapor velocities, and adequate adiabatic absorption of vapor between levels. Such an arrangement virtually eliminates inadequate wetting of the heat exchanger surface (a common problem in conventional heat exchangers). The effective vapor-solution contact minimizes heat and mass transfer resistances. The heat of absorption is conveyed to the coolant with minimal tube-side resistance due to the high heat transfer coefficients described above. This concept, therefore, addresses all the requirements for absorber design cited above, in an extremely compact and simple geometry.

Again with reference to FIGS. 1 and 2, each group 12 and 14 consist of 40 carbon steel tubes 16, 0.127 m long and 1.587 mm in diameter, with a tube center-to-center spacing of 3.175 mm, which results in a bundle 0.127 m wide×0.127 m long. These rows are stacked one on top of the other, in a criss-cross pattern, with a row center-to-center vertical spacing of 6.35 mm. This larger vertical spacing is allowed to accommodate the headers at the ends of the tubes. This arrangement, with 75 tube rows, results in an absorber that is 0.476 m high, with a total surface area of 1.9 $m^2$. The best coolant flow orientation for counterflow heat and mass transfer is to route it in parallel through all the tubes in one row, and in series through each row from the bottom to the top. However, such an orientation would result in an excessively high pressure drop on the coolant side, due to the very small cross-sectional area of each row, and high $L/D_i$ values. Thus, the coolant should be routed through multiple rows in parallel.

Figure 7:
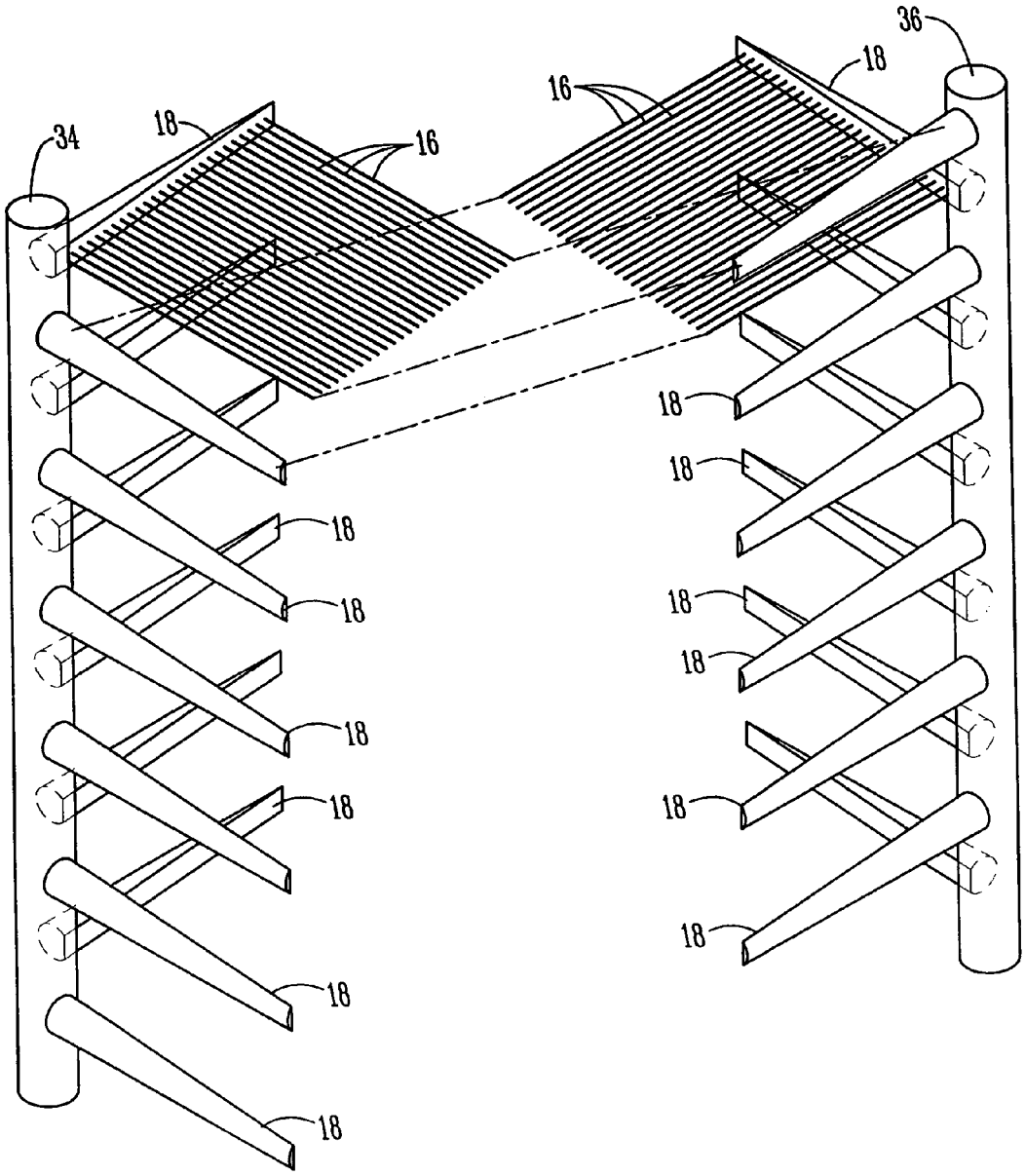
FIG. 7 is an exploded perspective schematic view of an alternate form of the invention.
Figure 8:
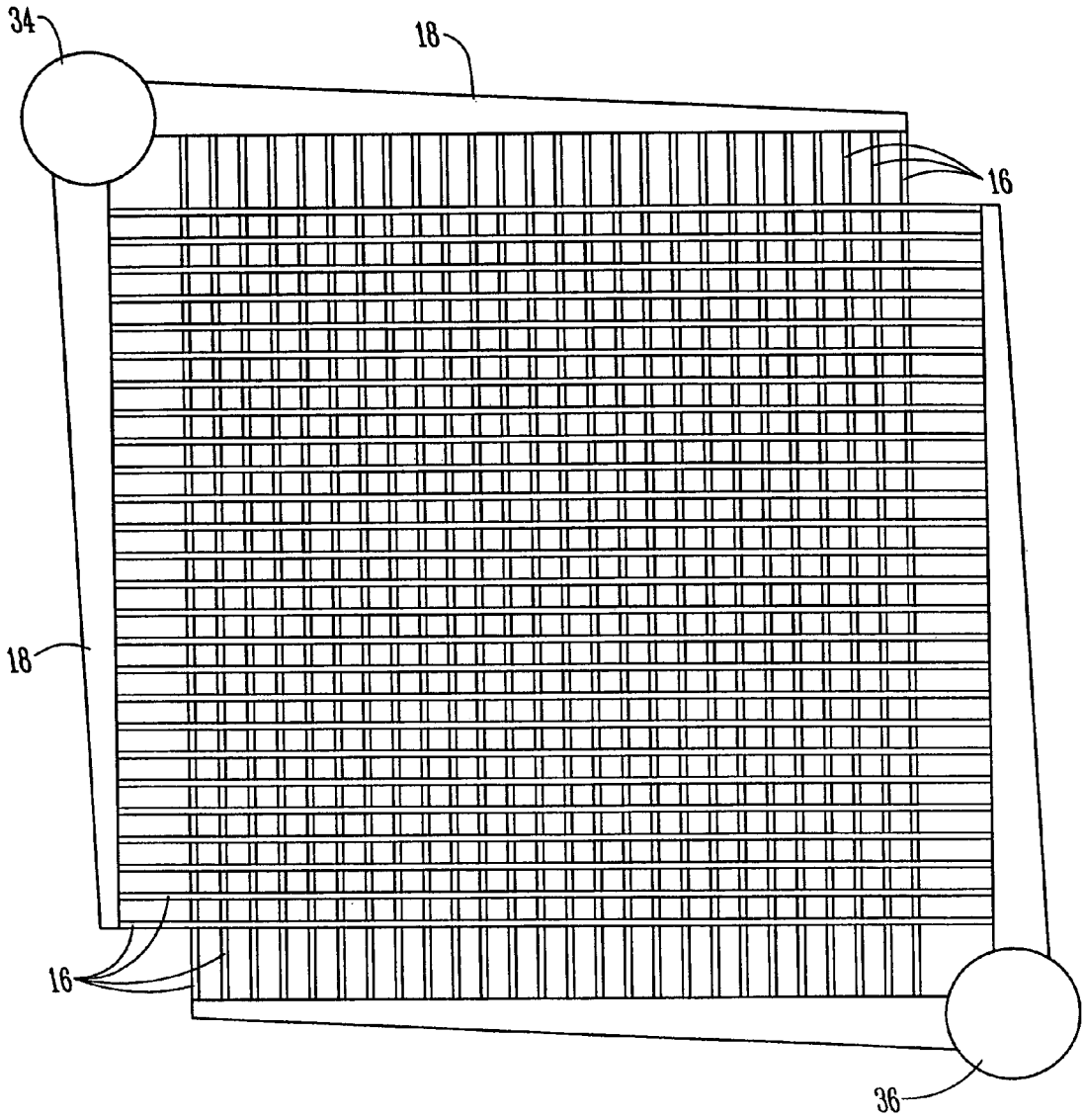
FIG. 8 is an enlarged-scale plan view of the assembled components of FIG. 7.

An alternate form of the invention is shown in FIGS. 7 and 8 which is a modification of the groups 12 and 14 of FIGS. 1 and 2.

Vertical tube masts 34 and 36 have coolant fluid pumped upwardly into headers 18, and which are secured in cantilever fashion by their larger ends. Each mast 34 and 36 has a header 18 at a level opposite to a header 18 on the opposite mast. Tubes 16 extend between these opposite headers 18 when they are juxta-positioned as shown in FIG. 8. This arrangement allows coolant to be simultaneously supplied to all the tubes in about 15 to 20 rows in parallel fashion with multiple sets of these rows of 15 to 20 tubes being in series, rather than each tube row being in series fashion as with the structure of FIG. 1. It also reduces the size of the pump required to move the coolant through the tubes 16.

Figure 6:
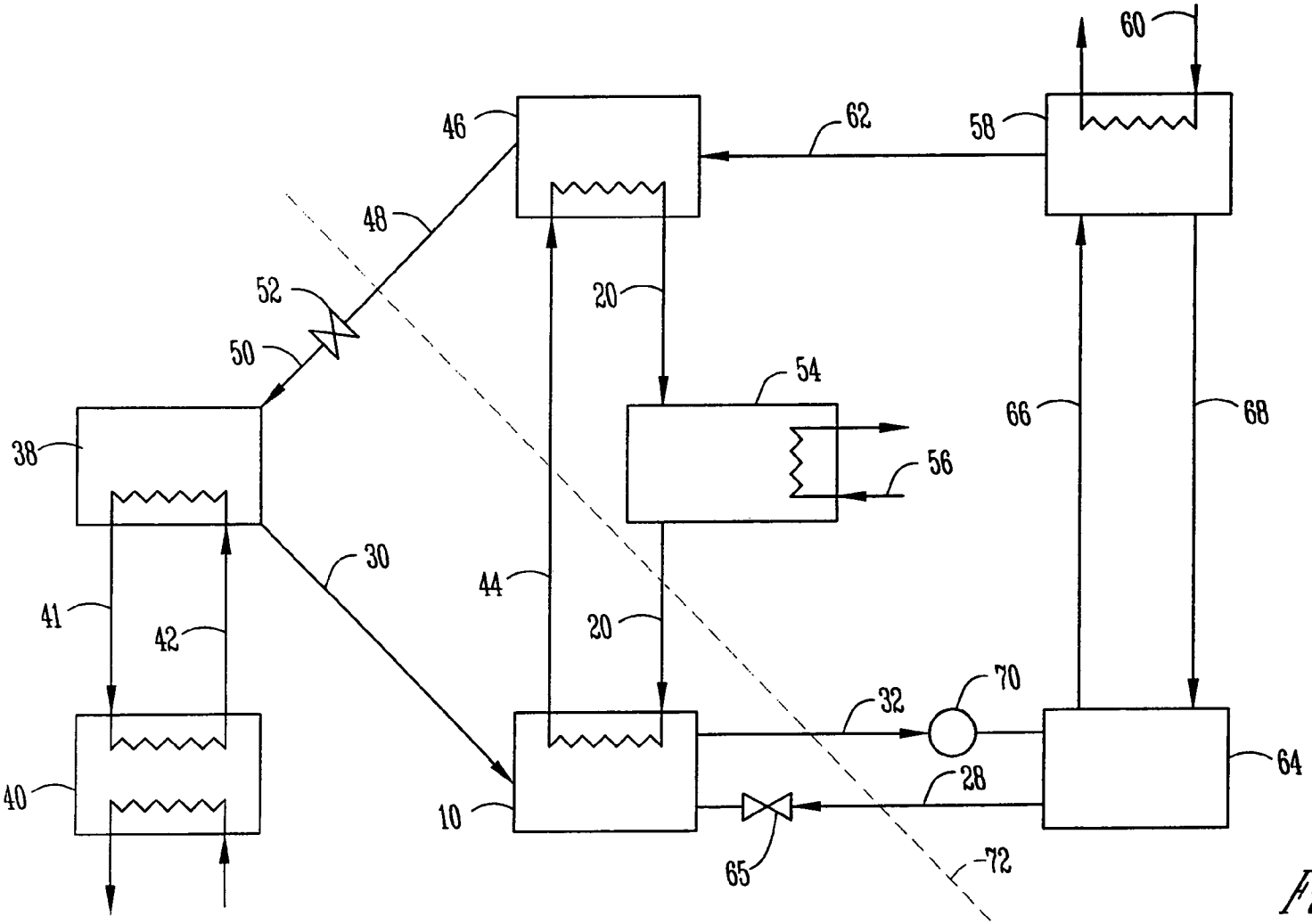
FIG. 6 is a schematic view of a system to practice the invention.

FIG. 6 shows a schematic system wherein an absorber support structure 10 is present in a single-effect hydronically coupled heat pump cooling mode. Minor modifications to the system enable heating mode operation. With reference to FIG. 6, an evaporator 38 is connected by means of chilled water/hydronic fluid line 41 to indoor coil 40. Line 42 is a return line from coil 40 to the evaporator 38. The previously referred to tube 30 connects the evaporator 38 to the absorber 10 to deliver refrigerant vapor to the absorber.

Line 44 connects absorber 10 to condenser 46. Condensed liquid refrigerant moves from condenser 46 in line 48 through expansion device 52 and thence through line 50 back to evaporator 38.

Previously described line or tube 20 connects condenser 46 to outdoor coil 54 which receives outdoor ambient air from the source 56.

A generator/desorber 58 receives thermal energy input (steam or gas heat) via line 60. Line 62 transmits refrigerant vapor from generator/desorber 58 back to condenser 46.

A solution heat exchanger 64 is connected to absorber 10 by previously described tube 28 in which valve 65 is imposed. Previously described concentrated solution tube 32 extends from absorber 10 to solution heat exchanger 64. Solution pump 70 is imposed in line 32.

The dotted line 72 in FIG. 6 designates the dividing line in the system with the low pressure components being below and to the left of the line and the high pressure components are above and to the right of the line.

The dilute solution being introduced through inlet 28 (FIG. 1) is a solution of ammonia and water with about a 20% concentration of ammonia. The concentrated solution moving out of the device 10 through conduit 32 (FIG. 1) is also comprised of a solution of ammonia and water with about a 50% concentration of ammonia. The vapor supplied to the system through conduit 30 is an ammonia vapor.

The present device 10 also may be used to generate a vapor or cause a vaporization phenomenon. The vaporization phenomenon is accomplished through a process known as desorption whereby a hot hydronic fluid is passed through coolant tubes 16 via conduit 30 and progresses upwardly through the grids of structure 10. At the same time, a concentrated fluid is passed externally over the tubes 16 and over the grids of the structure 10 downward via gravity. As the concentrated fluid passes over the tubes 16, the concentrated fluid forms a falling film on the exterior of the tubes 16. Droplets of the concentrated fluid intermix with each other during impingement on each succeeding set of groups 12 and 14. The droplets of the concentrated fluid vaporize on the exterior surface of the tubes 16 due to desorption. The vapor generated flows upwardly through structure 10 due to buoyancy.

This invention reveals a miniaturization technology for absorption heat and mass transfer components. Preliminary heat and mass transfer modeling of the temperature, mass, and concentration gradients across the absorber shows that this invention holds the potential for the development of extremely small absorption system components. For example, an absorber with a heat rejection rate of 19.28 kW, which corresponds approximately to a 10.55 kW space-cooling load in the evaporator, can be built in a very small 0.127 m×0.127 m×, 0.476 m envelope. The concept allows modular designs, in which a wide range of absorption loads can be transferred simply by changing the number of tube rows, tube-to-tube spacings, and pass arrangements. Furthermore, the technology can be used for almost all absorption heat pump components (absorbers, desorbers, condensers, rectifiers, and evaporators) and to several industries involved in binary-fluid processes. It is believed that this simplicity of the transfer surface (smooth round tube), and modularity and uniformity of surface type and configuration throughout the system will be extremely helpful in the fabrication and commercialization of absorption systems to the small heating and cooling load markets.

It is therefore seen that this invention will achieve at least all of its stated objectives.

What is claimed is:

1. A method of enabling a hot hydronic fluid to transfer heat to a second fluid to cause desorption in the second fluid and generate an upward flowing vapor, comprising, forming a horizontal first grid of closely spaced narrow diameter hollow tubes;

placing a plurality of similar grids in a horizontal position and in close vertical spaced relation to the first grid and to each other;

fluidly interconnecting the tubes of each grid;

passing a hot hydronic fluid upwardly for movement through the fluidly interconnected grids;

taking a second fluid and continuously disbursing the fluid substantially over the first grid wherein the second fluid will releasably cling to the tubes of the first grid, and thence drop sequentially to releasably cling sequentially to the tubes of remaining grids;

maintaining an open space between each grid so that when quantities of the second fluid sequentially release from the tubes of the first grid, they can fall directly and freely by gravity for impingement on a lower grid to be physically intermixed by the impingement; and continuing the impingement as quantities of said second fluid progressively drop by gravity onto the grids;

whereupon each impingement will progressively and sequentially intermix the second fluid to cause desorption and generate an upward flowing vapor.

* * * * *

UNITED STATES PATENT AND TRADEMARK OFFICE

CERTIFICATE OF CORRECTION

PATENT NO. : 7,066,241 B2
APPLICATION NO. : 10/894325
DATED : June 27, 2006
INVENTOR(S) : Srinivas Garimella It is certified that error appears in the above-identified patent and that said Letters Patent is hereby corrected as shown below:

Cover page, item (73) strike "Iowa State Research Foundation" and insert --Iowa State Research Foundation, Inc. --.

Signed and Sealed this

Twelfth Day of September, 2006

JON W. DUDAS
*Director of the United States Patent and Trademark Office*